US008282354B2

(12) United States Patent
Spangler

(10) Patent No.: US 8,282,354 B2
(45) Date of Patent: Oct. 9, 2012

(54) REDUCED WEIGHT BLADE FOR A GAS TURBINE ENGINE

(75) Inventor: Brandon W. Spangler, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 1168 days.

(21) Appl. No.: 12/103,779

(22) Filed: Apr. 16, 2008

(65) Prior Publication Data

US 2009/0263251 A1 Oct. 22, 2009

(51) Int. Cl.
*F01D 5/14* (2006.01)

(52) U.S. Cl. ..... 416/193 A; 416/239; 416/96 R; 416/248

(58) Field of Classification Search ..... 416/193 A, 416/239, 241 R, 248
See application file for complete search history.

(56) References Cited

U.S. PATENT DOCUMENTS

| | | | | |
|---|---|---|---|---|
| 4,265,594 | A * | 5/1981 | Eggmann | 416/193 A |
| 4,516,910 | A * | 5/1985 | Bouiller et al. | 416/190 |
| 5,215,442 | A * | 6/1993 | Steckle et al. | 416/248 |
| 5,261,790 | A * | 11/1993 | Dietz et al. | 416/193 A |
| 6,183,195 | B1 | 2/2001 | Tremaine | |
| 6,227,801 | B1 | 5/2001 | Liu | |
| 6,441,341 | B1 | 8/2002 | Steibel et al. | |
| 6,508,620 | B2 | 1/2003 | Sreekanth et al. | |
| 6,647,730 | B2 | 11/2003 | Liu | |
| 6,652,222 | B1 | 11/2003 | Wojtyczka et al. | |
| 6,735,956 | B2 | 5/2004 | Romani | |
| 6,786,696 | B2 | 9/2004 | Herman et al. | |
| 6,832,893 | B2 | 12/2004 | Chevrefils et al. | |
| 6,881,036 | B2 | 4/2005 | Hornick et al. | |
| 6,991,428 | B2 | 1/2006 | Crane | |
| 7,001,150 | B2 | 2/2006 | Fett et al. | |
| 7,121,758 | B2 | 10/2006 | McMillan et al. | |
| 7,121,802 | B2 | 10/2006 | Athans et al. | |
| 7,153,102 | B2 | 12/2006 | Stone | |
| 7,156,621 | B2 | 1/2007 | Stone | |
| 7,229,249 | B2 | 6/2007 | Durocher et al. | |
| 7,252,481 | B2 | 8/2007 | Stone | |
| 7,300,246 | B2 | 11/2007 | Durocher et al. | |
| 7,766,621 | B1 * | 8/2010 | Maggs et al. | 416/193 A |

FOREIGN PATENT DOCUMENTS

| | | |
|---|---|---|
| EP | 537922 | 11/1993 |
| EP | 1205634 | 5/2002 |
| EP | 1795703 | 6/2007 |
| GB | 2226368 | 6/1990 |

OTHER PUBLICATIONS

EP Search Report dated Apr. 10, 2012.

* cited by examiner

*Primary Examiner* — Ninh H Nguyen
(74) *Attorney, Agent, or Firm* — Carlson, Gaskey & Olds

(57) ABSTRACT

A rotor blade for a gas turbine engine having an edge buttress having an aperture. A method of reducing rotor blade weight includes removing material from within a truss area bounded by a platform section, an internal airfoil cooling passage, and an underplatform fillet.

19 Claims, 8 Drawing Sheets

REDUCED WEIGHT BLADE FOR A GAS TURBINE ENGINE

BACKGROUND

The present invention relates to a gas turbine engine, and more particularly to a rotor blade thereof.

Gas turbine engines often include a multiple of rotor assemblies within a fan, compressor and turbine section. Each rotor assembly has a multitude of blades attached about a circumference of a rotor disc. Each of the blades is spaced a distance apart from adjacent blades to accommodate movement and expansion during operation. Each blade includes an attachment section that attaches to the rotor disc, a platform section, and an airfoil section that extends radially outwardly from the platform section.

When engine weight becomes a concern, emphasis is directed toward the reduction of blade weight since every one pound of weight in the set of blades is worth about three pounds of weight in the rotor disk due to centrifugal forces. Weight is typically removed from the blade by thinning airfoil walls and ribs until a minimum thickness is achieved from a manufacturing and structural standpoint.

Although there may be significant mass in the attachment region of the blade, this mass is required to prevent fracture of the blade when centrifugal and airfoil bending loads are applied.

SUMMARY

A rotor blade for a turbine engine according to an exemplary aspect of the present invention includes: an edge buttress having an aperture, the aperture extends at least partially through the edge buttress.

A rotor blade for a turbine engine according to an exemplary aspect of the present invention includes: a platform section; an airfoil section which extends from the platform section; a neck section which extends from the platform section opposite the airfoil section, the neck section and the airfoil section contains an internal airfoil cooling passage; and an underplatform fillet adjacent the neck section and the platform section. The platform section, the internal airfoil cooling passage, and the underplatform fillet defines a truss shape which bounds an aperture.

A method of reducing a rotor blade weight according to an exemplary aspect of the present invention includes: removing material from within a truss area bounded by a platform section, an internal airfoil cooling passage, and an underplatform fillet of a rotor blade.

BRIEF DESCRIPTION OF THE DRAWINGS

The various features and advantages of this invention will become apparent to those skilled in the art from the following detailed description of the disclosed non-limiting embodiment. The drawings that accompany the detailed description can be briefly described as follows.

DETAILED DESCRIPTION OF THE EXEMPLARY EMBODIMENTS

Figure 1:
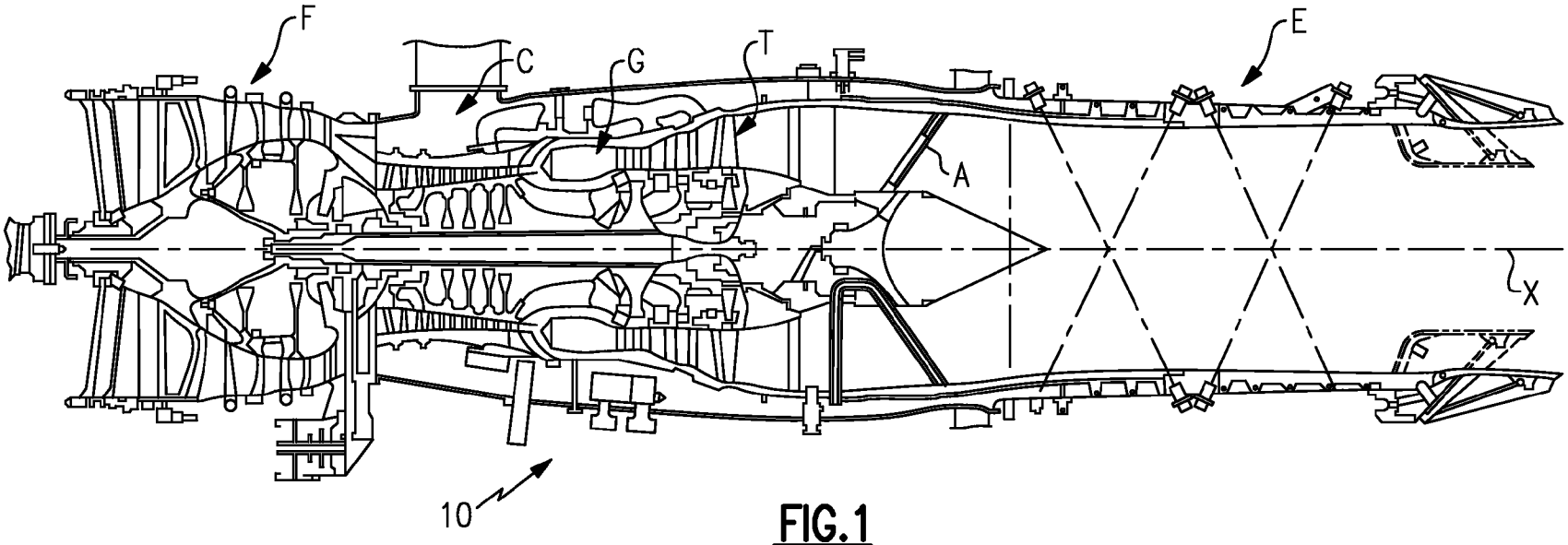
FIG. 1 is a schematic illustration of a gas turbine engine.

FIG. 1 schematically illustrates a gas turbine engine 10 which generally includes a fan section F, a compressor section C, a combustor section G, a turbine section T, an augmentor section A, and an exhaust duct assembly E. The compressor section C, combustor section G, and turbine section T are generally referred to as the core engine. An engine longitudinal axis X is centrally disposed and extends longitudinally through these sections. Although a particular gas turbine engine configuration is illustrated and described in the disclosed embodiment, other turbine engine types will also benefit herefrom.

Figure 2:
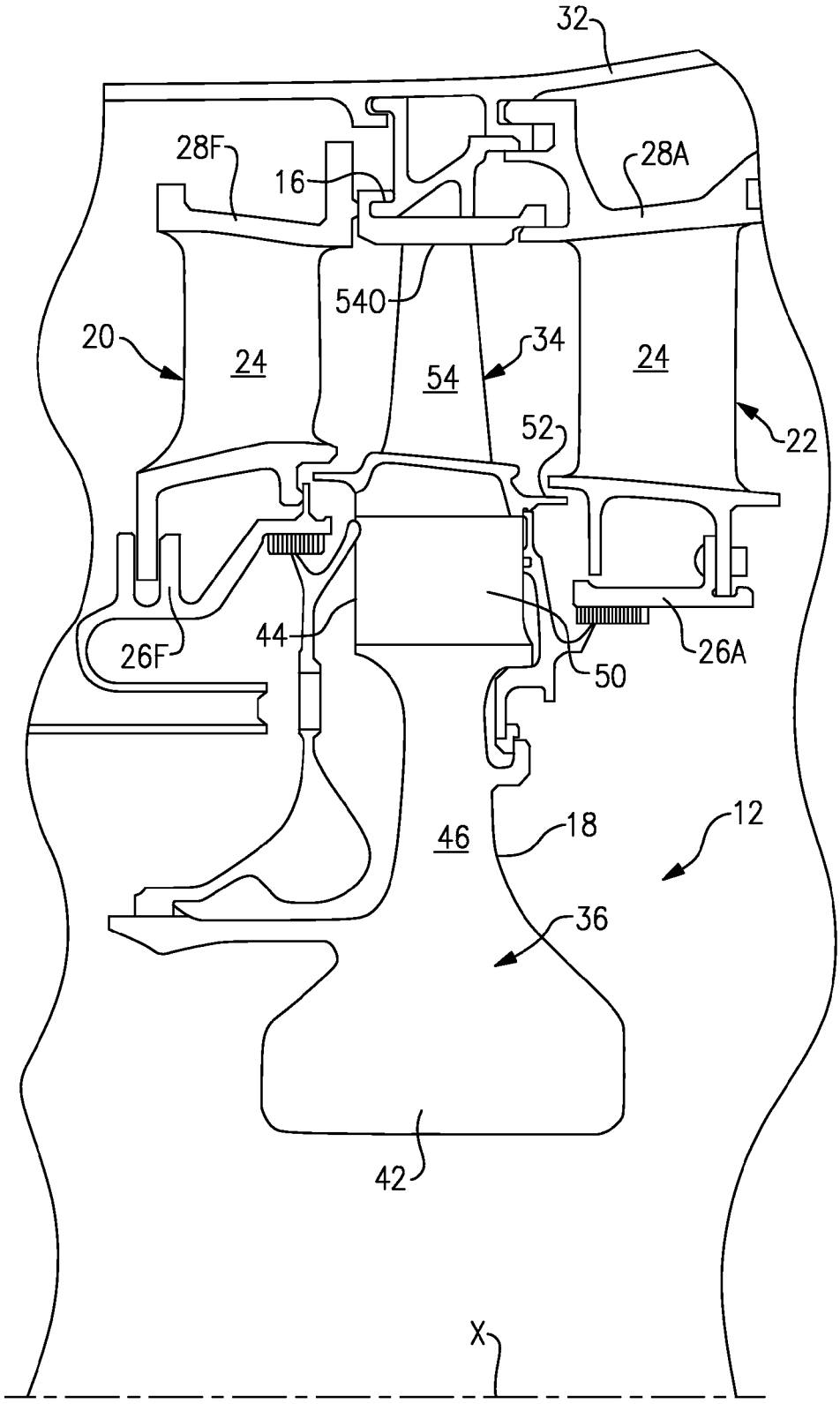
FIG. 2 is a general sectional diagrammatic view of a gas turbine engine HPT section of the engine of FIG. 1.

FIG. 2 schematically illustrates a High Pressure Turbine (HPT) section of the gas turbine engine 10 having a turbine disc assembly 12 within the turbine section T disposed along the engine longitudinal axis X. It should be understood that a multiple of discs may be contained within each engine section and that although the HPT section is illustrated and described in the disclosed embodiment, other sections which have other blades which have a truss-like structure within a neck section such as low pressure turbine blades, will also benefit herefrom.

The HPT section generally includes a blade outer air seal assembly 16 with a rotor assembly 18 disposed between a forward stationary vane assembly 20 and an aft stationary vane assembly 22. Each vane assembly 20, 22 include a plurality of vanes 24 circumferentially disposed around an inner vane support 26. The vanes 24 of each assembly 20, 22 extend between the inner vane support 26F, 26A and an outer vane platform 28F, 28A. The outer vane platforms 28F, 28A are attached to an engine case 32.

The rotor assembly 18 includes a plurality of blades 34 circumferentially disposed around a rotor disk 36. The rotor disk 36 generally includes a hub 42, a rim 44, and a web 46 which extends therebetween. Each blade 34 generally includes an attachment section 50, a platform section 52 and an airfoil section 54 along a longitudinal axis B. The outer edge of each airfoil section 54 is a blade tip 54O which is adjacent the blade outer air seal assembly 16.

Figure 3:
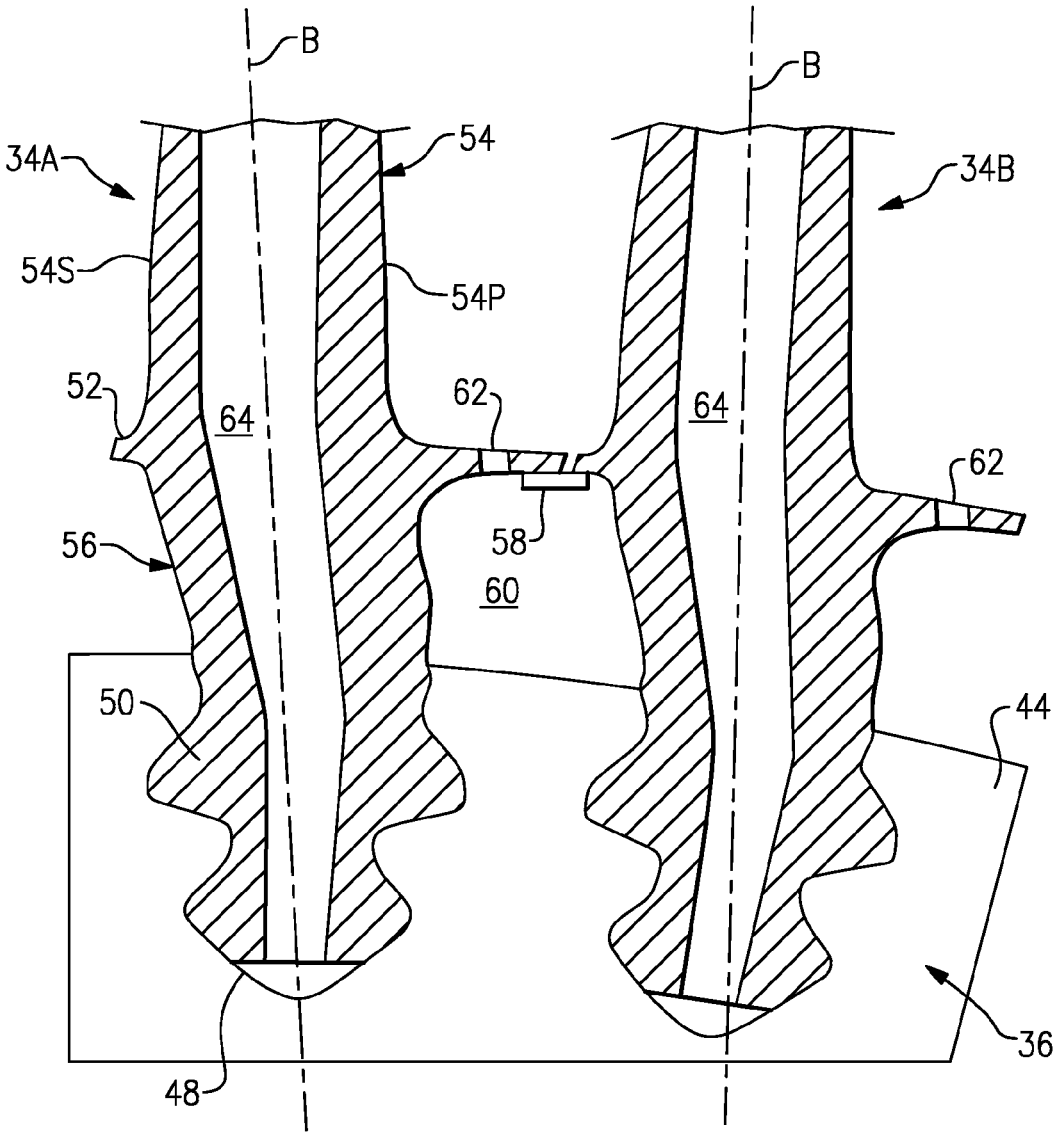
FIG. 3 is an expanded front sectional view of a rotor blade mounted to a rotor disc.

Referring to FIG. 3, the airfoil section 54 defines a suction side 54S and a pressure side 54P relative an axis of rotation X of the disk 36. Each of the blades 34 is received within a blade slot 48 formed within the rim 44 of the rotor disk 36. The blade slot 48 includes a contour such as a fir-tree or bulb type which corresponds with a contour of the attachment section 50 to provide engagement therewith.

Each blade 34 further includes a neck section 56 between the attachment section 50 and the platform section 52. The platform section 52 of one blade 34A abuts a platform section 52 of a second blade 34B such that underplatform section hardware 58 (illustrated schematically) such as a damper and featherseal may be located at the interface therebetween to seal the rim cavity 60 between the rim 44 and the platform sections 52. Platform cooling apertures 62 are located through the platform section 52 to provide a cooling airflow to the platform sections 52 on both the pressure side and the suction side. An internal airfoil cooling passage 64 extends through the blade 34 to communicate cooling airflow from within the blade slot 48 through cooling apertures 65 located adjacent the airfoil section trailing edge 54T (FIGS. 2, 4A, and 4B).

Figure 4B:
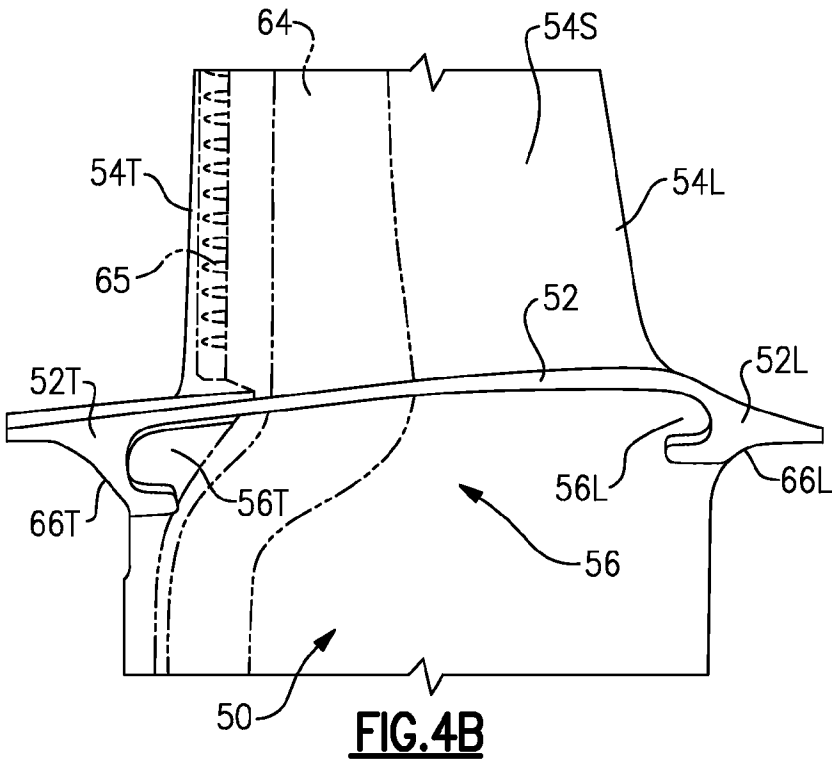
FIG. 4B is a suction side partial phantom view of a rotor blade.
Figure 4A:
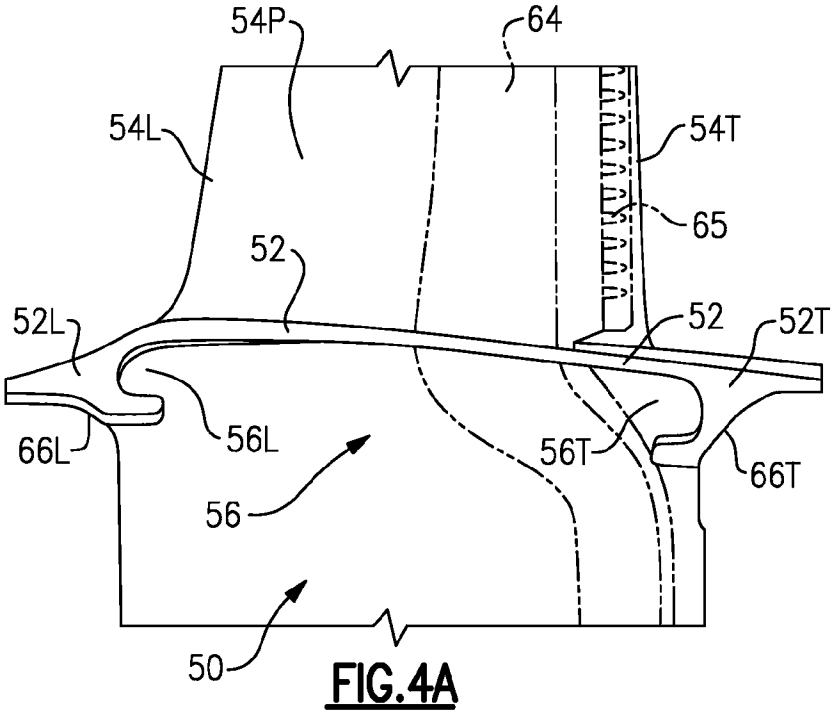
FIG. 4A is a pressure side partial phantom view of a rotor blade.

Referring to FIGS. 4A and 4B, a leading edge buttress 56L and a trailing edge buttress 56T are generally located in the neck section 56 generally adjacent an airfoil leading edge 54L and an airfoil trailing edge 54T. Dead mass exists within the leading edge buttress 56L and the trailing edge buttress 56T as a byproduct of other requirements. The dead mass in the leading edge buttress 56L and the trailing edge buttress 56T is bounded by the platform section 52, the internal airfoil cooling passage 64 (for the trailing edge buttress 54T), and a respective underplatform fillet 66L, 66T. The radius and location of the underplatform fillet 66L, 66T is defined generally to prevent a platform leading edge 52L and a platform trailing edge 52T from curling toward the attachment section 50.

Figure 5:
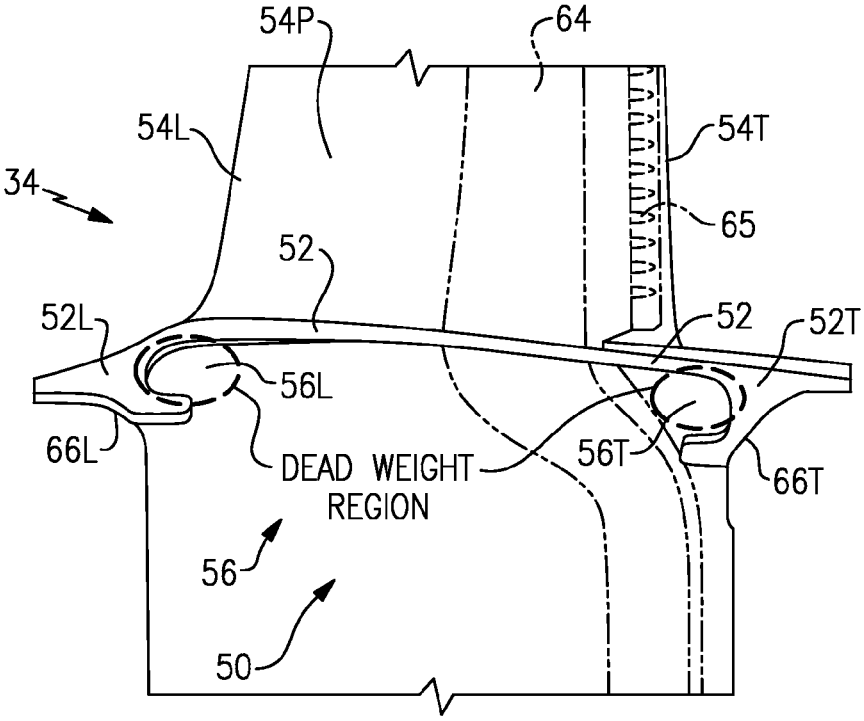
FIG. 5 is a pressure side view of a rotor blade illustrating a dead weight region.
Figure 6:
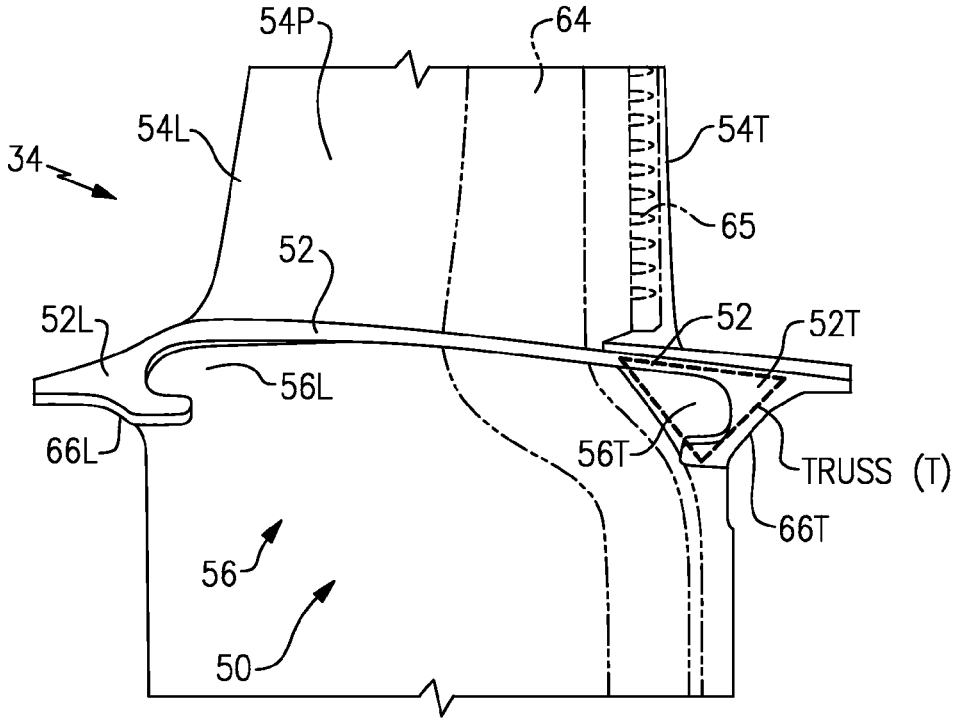
FIG. 6 is a pressure side view of a rotor blade illustrating a truss structure defined about the dead weight region of FIG. 5.

The internal cooling passage 64 transitions smoothly away from the underplatform fillet 66T so that the cooling air transitions smoothly from the neck section 56 into the airfoil section 54. The loads induced by the platform section 52 are transferred into the neck section 56 through the underplatform fillet 66L, 66T while loads induced in the airfoil section 54 are transferred into the neck section 56 along the wall of the internal airfoil cooling passage 64. This results in a dead mass region between the underplatform fillet 66T and the internal airfoil cooling passage 64 (FIG. 5). That is, a truss T is essentially defined by the platform section 52, the wall of the internal airfoil cooling passage 64, and the underplatform fillet 66T (FIG. 6). Applicant has determined that this dead mass can be removed without adversely affecting the load or stresses in the blade 34.

Figure 7A:
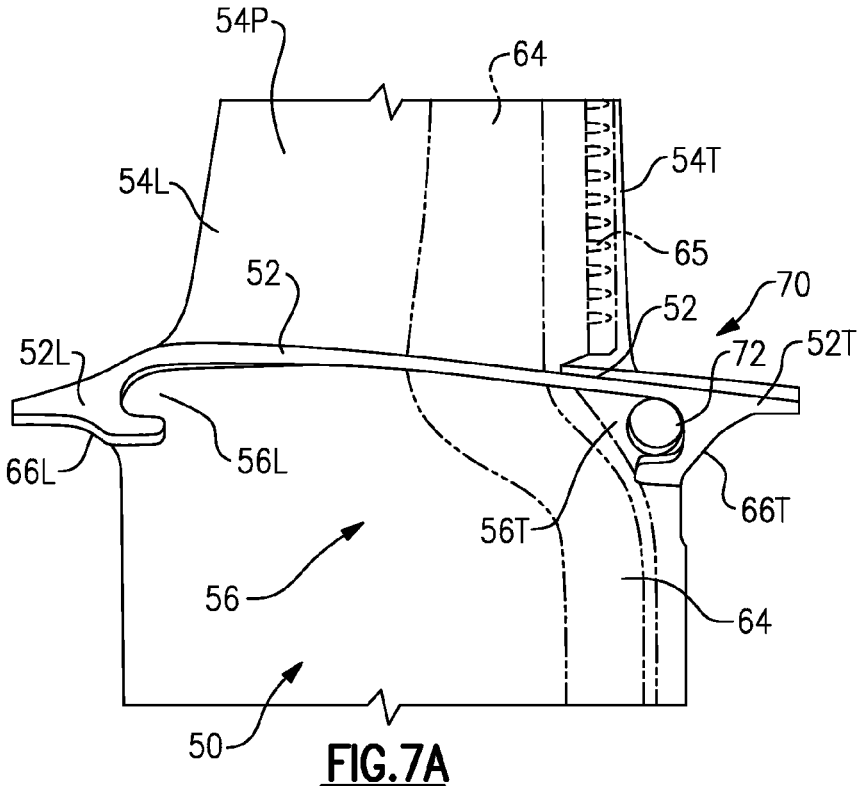
FIG. 7A is a pressure side partial phantom view of a rotor blade illustrating a weight reduction feature.
Figure 7B:
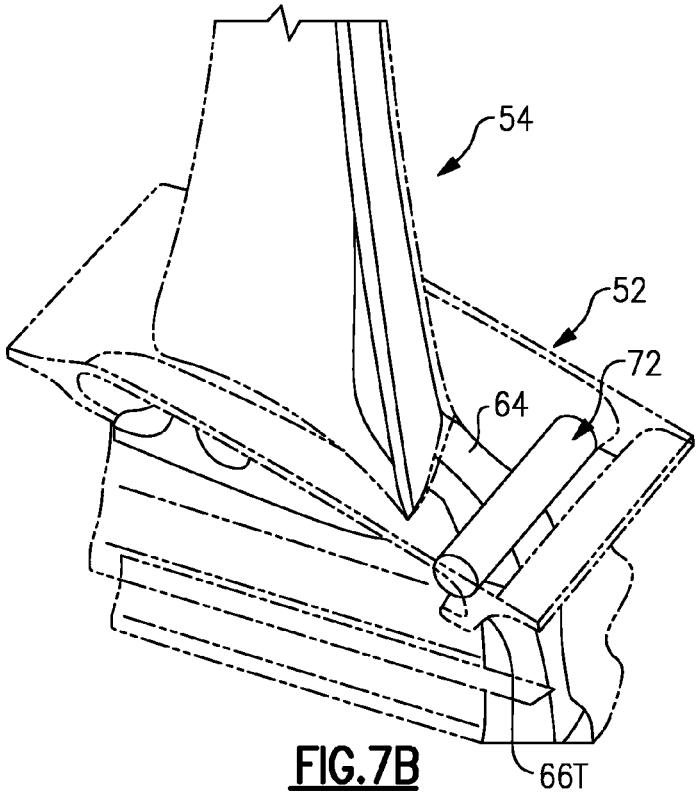
FIG. 7B is a suction side partial phantom view of a rotor blade illustrating a weight reduction feature.
Figure 7C:
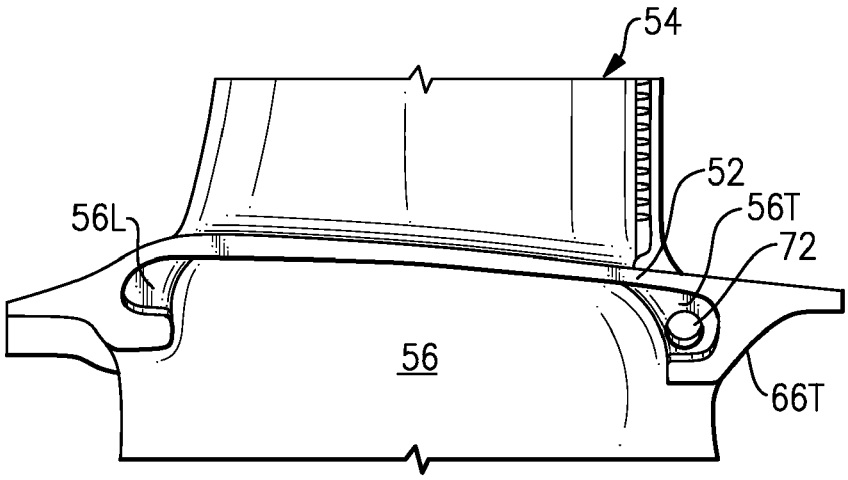
FIG. 7C is a pressure side rotor blade surface contour view illustrating a weight reduction feature.
Figure 8A:
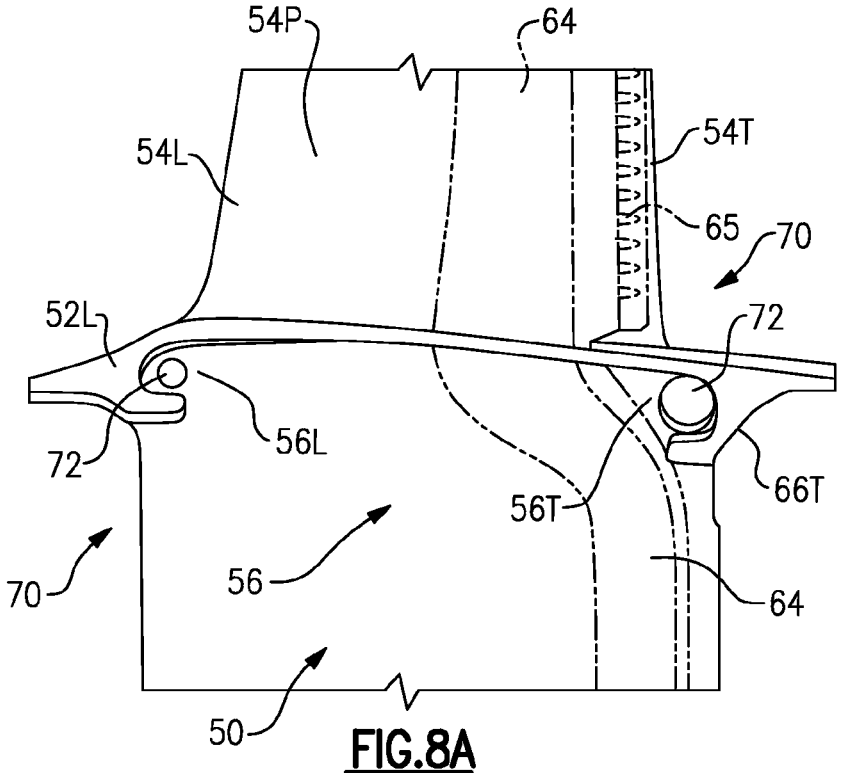
FIG. 8A is a pressure side partial phantom view of a rotor blade illustrating weight reduction feature.
Figure 8B:
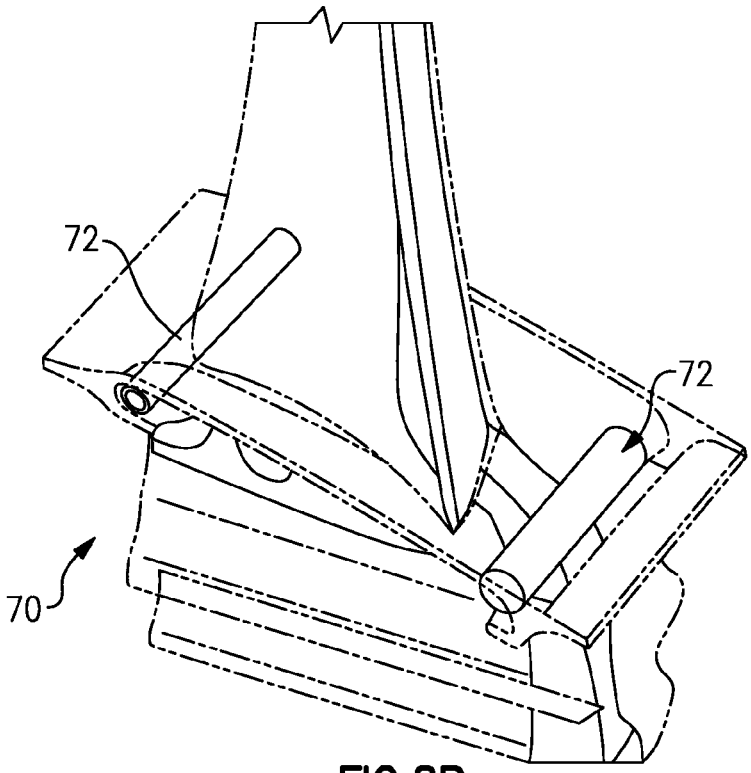
FIG. 8B is a perspective phantom view of a rotor blade illustrating the weight reduction feature.

Referring to FIGS. 7A and 7B, a blade weight reduction region 70 includes an aperture 72 located in either or both of the trailing edge buttress 56T and the leading edge buttress 56L (FIGS. 8A and 8B). The aperture 72 may extend at least partially into the neck section 56 from either or both of the pressure side and the suction side of the blade 34. That is, the aperture may essentially define a dimple or other blade weight reduction region 70 of any shape. Alternatively, the aperture 72 may extend completely though the neck section 56 as the aperture 72 spans the pressure side and the suction side of the blade 34 to thereby form an open truss-like feature. That is, the blade weight reduction region 70 is bounded by the platform section 52, the internal airfoil cooling passage 64, and the underplatform fillet 66T to transfer loads in the airfoil section 54 and platform section 52 into the neck section 56 then into the attachment section 50. Any aperture, dimple or other material removal within the blade weight reduction region 70 may thereby be interpreted as the aperture 72 ad defined herein. The area through which the aperture 72 passes is typically slightly thicker than the adjacent neck area 56 which further increases the weight reduction (contour also illustrated in FIG. 7C). This weight reduction may alternatively or additionally be located within the leading edge buttress 56L (FIGS. 8A and 8B).

Although the aperture 72 is illustrated as a cylinder which is generally circular in cross-section, it should be understood that other cross-section shapes may alternatively or additionally be provided. In one non-limiting embodiment, the aperture 72 may be formed early during the casting process by inserting a quartz rod into the wax die or later during the machining process by drilling with an EDM electrode.

Figure 9:
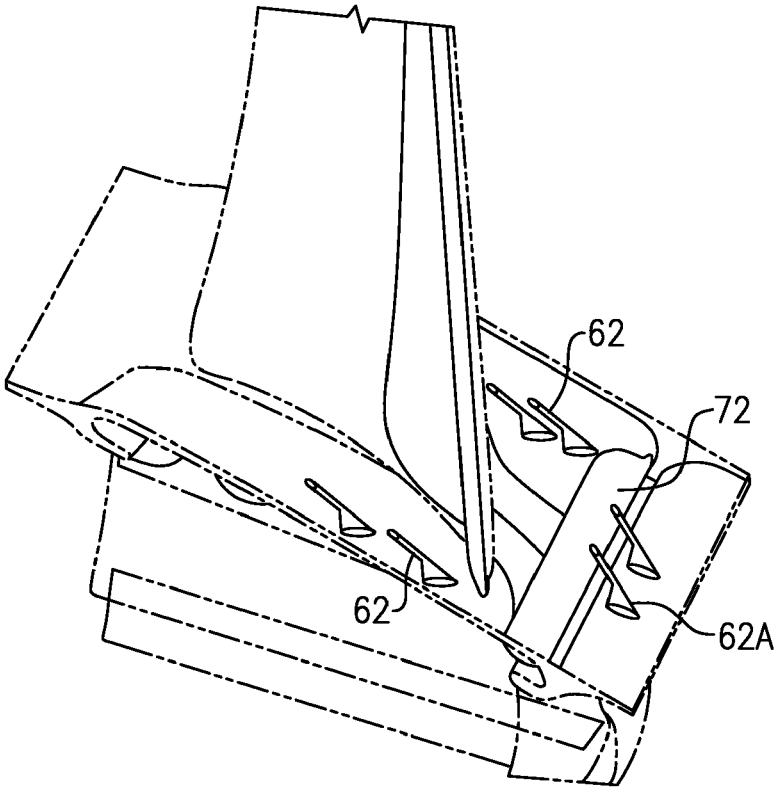
FIG. 9 is a perspective phantom view of a rotor blade illustrating the weight reduction feature with supplemental platform cooling apertures that communicate with the weight reduction feature.

Referring to FIG. 9, the aperture 72 may supplement the platform cooling apertures 62 through the incorporation of aperture platform cooling apertures 62A. That is, the rim cavity 60 (FIG. 3) supplies cooling airflow into the aperture 72 which thereby communicates the cooling airflow from the aperture 72 through the platform section 52 by way of the aperture platform cooling apertures 62A. In one non-limiting embodiment, the aperture platform cooling apertures 62A extend through the platform trailing edge 56T.

The blade weight reduction feature removes weight from the blade without adversely affecting the load or stresses in the blade.

It should be understood that relative positional terms such as "forward," "aft," "upper," "lower," "above," "below," and the like are with reference to the normal operational attitude of the vehicle and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations are possible in light of the above teachings. Non-limiting embodiments are disclosed herein, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A rotor blade for a turbine engine comprising:

an edge buttress having an aperture, said aperture extends at least partially through said edge buttress and an aperture platform cooling aperture in communication with said aperture.

2. The rotor blade as recited in claim 1, wherein said rotor blade is high pressure turbine blade.

3. The rotor blade as recited in claim 1, wherein said aperture extends completely through a neck section adjacent said edge buttress.

4. The rotor blade as recited in claim 1, wherein said aperture is circular in cross-section.

5. The rotor blade as recited in claim 1, wherein said edge buttress is a trailing edge buttress.

6. The rotor blade as recited in claim 1, wherein said edge buttress is a leading edge buttress.

7. The rotor blade as recited in claim 1, wherein said aperture is located adjacent but does not communicate with an internal airfoil cooling passage within a neck section and an airfoil section of said rotor blade.

8. The rotor blade as recited in claim 1, wherein said aperture platform cooling aperture in communication with a platform section of said rotor blade.

9. The rotor blade as recited in claim 1, wherein said edge buttress is located adjacent a neck section between a platform section and an attachment section of said rotor blade, said aperture extends completely through said neck section.

10. A rotor blade for a turbine engine comprising:

a platform section;

an airfoil section which extends from said platform section;

a neck section which extends from said platform section opposite said airfoil section, said neck section and said airfoil section contains an internal airfoil cooling passage; and an underplatform fillet adjacent said neck section and said platform section, said platform section, said internal airfoil cooling passage, and said underplatform fillet defines a truss shape which bounds an aperture wherein said truss shape is generally triangular in shape.

11. The rotor blade as recited in claim 10, wherein said aperture extends completely through said neck section.

12. The rotor blade as recited in claim 10, wherein said aperture defines a cylinder.

13. The rotor blade as recited in claim 10, wherein said platform section defines said underplatform fillet, said underplatform fillet at least partially hook-shaped.

14. A method of reducing rotor blade weight comprising:

removing material from within a truss area bounded by a platform section, an internal airfoil cooling passage, and an underplatform fillet of a rotor blade and removing material to define an aperture which extends completely through a neck section of the rotor blade.

15. The method as recited in claim 14, removing material to define an aperture.

16. The method as recited in claim 14, removing material to define a cylindrical aperture.

17. The method as recited in claim 14, removing material to define an aperture which extends completely though a neck section of the rotor blade.

18. The method as recited in claim 14, forming an aperture platform cooling aperture though the platform section, the aperture platform cooling aperture in communication with the aperture which extends completely though the neck section of the rotor blade.

19. A rotor blade for a turbine engine comprising:

a platform section;

an airfoil section which extends from said platform section;

a neck section which extends from said platform section opposite said airfoil section, said neck section and said airfoil section contains an internal airfoil cooling passage; and an underplatform fillet adjacent said neck section and said platform section, said platform section, said internal airfoil cooling passage, and said underplatform fillet defines a truss shape which bounds an aperture wherein said aperture extends completely through said neck section.

* * * * *